US006259873B1

(12) United States Patent
Shifley et al.

(10) Patent No.: US 6,259,873 B1
(45) Date of Patent: Jul. 10, 2001

(54) CANTILEVER DRUM MOUNT FOR DOCUMENT PRINTER/COPIER

(75) Inventors: James D. Shifley, Spencerport; Gregory L. Kowalski, Victor, both of NY (US); Andreas Dickhoff, Breitwiesen (DE); Andreas G. Nagy, Fairport, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/574,275

(22) Filed: May 19, 2000

(51) Int. Cl.[7] ..... G03G 21/16

(52) U.S. Cl. ..... 399/110; 399/117

(58) Field of Search ..... 399/116, 117, 399/164, 159, 110; 492/47

(56) References Cited

U.S. PATENT DOCUMENTS

| | | | | |
|---|---|---|---|---|
| 4,119,032 | | 10/1978 | Hollis | 101/216 |
| 5,758,243 | * | 5/1998 | Haneda et al. | 399/117 X |
| 6,002,897 | * | 12/1999 | Kohno et al. | 399/117 |

* cited by examiner

*Primary Examiner*—Susan S. Y. Lee
(74) *Attorney, Agent, or Firm*—James D. Leimbach

(57) ABSTRACT

A cantilever drum-mounting apparatus adapted for use in a document printer/copier comprises: (i) a housing having an opening therein; (ii) a carriage movably mounted within the opening and adapted to receive, retain and rotatably support an axle of a drum; and (iii) a plurality of guide rollers, rotatably mounted on the carriage and engageable with opposing outer surface of the housing, for limiting movement of the carriage to a direction substantially normal to the axis for drum rotation. Preferably, movement of the carriage is controlled by the actuator of an air cylinder that cooperates with one or more reference surfaces within the housing opening to locate the drum axle at a desired position.

9 Claims, 11 Drawing Sheets

CANTILEVER DRUM MOUNT FOR DOCUMENT PRINTER/COPIER

CROSS-REFERENCE TO RELATED APPLICATIONS

Reference is made to the commonly assigned U.S. patent applications, the respective disclosures of which being incorporated herein by reference:

(1) U.S. application Ser. No. 09/474,352, filed on Dec. 29, 1999 and entitled "Apparatus for Positioning Work Stations in a Document Printer/Copier".

(2) U.S. patent application Ser. No. 09/574,054, filed May 18, 2000 entitled "Pin Mount for Optical Writer/Recording Element in a Document Printer/Copier."

(3) U.S. patent application Ser. No. 09/574,425, filed May 19, 2000 entitled "Document Printer/Copier with Decoupleable Drum-Support Member".

(4) U.S. patent application Ser. No. 09/574,447, filed May 19, 2000 and entitled "Image Transfer Drum for Document Printer/Copier".

FIELD OF THE INVENTION

The present invention relates to field of document printing and copying. More particularly, it relates to an apparatus for rotatably supporting image-recording and image-transfer drums in spaced parallel relationship while being able to adjust the spacing between the drums.

BACKGROUND OF THE INVENTION

Automated electrophotographic copiers and printers have been known for nearly fifty years. Copiers and printers differ only from an input standpoint, copiers being adapted to receive hard copy input, whereas printers are adapted to receive an input in electronic form, e.g., from a computer terminal. Both carry out the basic electrophotographic imaging process of uniformly charging a photoconductive layer with electrostatic charge, imagewise exposing the charged layer to radiation adapted to discharge the layer, thereby leaving behind a latent charge image, and applying pigmented electroscopic particles (toner) to the charge image to render it visible. Most often, the toner image so formed is transferred to a receiver sheet whereupon the toner image is permanentized by heat and/or pressure. Optionally, for example, to extend the lifetime of the photoconductive recording element, the toner image formed on the image-recording drum is transferred to an intermediate transfer drum or the like before it is again transferred to the receiver sheet. In the case of full color copying and printing, multiple color-separated toner images (e.g., cyan, magenta, yellow and black) are produced by the above process and transferred in registration to a receiver sheet.

Since the inception of electrophotographic printers/copiers, the "holy grail" for many manufacturers has been to produce images of photographic quality, both monochromatic and full color. As will be appreciated, the quality of a full color image is determined not only by the respective qualities of each of the color-separated toner images formed on the photoconductive recording element(s), but also by the degree with which such images can be transferred from the recording element(s) and brought into perfect registration on the image receiver sheet. Such image quality of the color-separated images and the registration thereof, in turn, depend in large part upon the precision with which the various work-stations or subsystems that carry out the electrophotographic process can be physically placed relative on the surface of the recording element. Thus, various schemes have been proposed and used in the past that address this technical problem.

While focusing on image-quality and registration issues, printer manufacturers are ever mindful of lowering manufacturing and service costs. Thus, substantial efforts have been made to simplify service and maintenance procedures so that the need for service calls by highly trained technicians and specialists can be minimized. Ideally, for example, all of the major work-stations of the printer, e.g. the charging, exposure, development, transfer and cleaning stations, as well as the recording element itself, should be replaceable by the end user or customer with no sacrifice being made to the ultimate image quality. Even where the services of a trained technician are required, the time to implement such replacements should be minimal. The achievement of this goal not only requires that each of the printer work-stations be modularized so as effect a "plug and play" concept, but also requires that a very precise and highly reliable work station-registration scheme be designed so that each work station, upon being removed from the printer frame for servicing and/or replacement, can be returned to within a few microns of its nominal position. In the case of high quality color printing, the respective placements of the printer work-stations is particularly critical and skilled servicing personnel are usually required to make the major sub-system changes. Obviously, the need for service assistance should be minimized.

In the above-referenced U.S. application Ser. No. 09/474,352, a work station registration scheme for an electrophotographic printer is disclosed in which a plurality of dowel pins on the printer frame serve to locate both a photoconductive drum assembly and an image transfer drum assembly. Each drum assembly comprises a pair of drum-support members, commonly referred to as "spiders," located at opposite ends of the drum. Each spider contains a centrally located bearing for rotatably supporting a drum axle, and a plurality of outwardly extending mechanical fiducials, e.g. bullet-shaped members, which are adapted to mate with complimentary structure, e.g., V-notched blocks, mounted on each work station to precisely locate and space the work-stations relative to the drum's photoconductive surface. When it comes time to replace the image-recording and/or transfer drums, the work-stations are retracted from their respective positions adjacent the drum surface, thereby providing clearance for drum removal, and the entire drum assembly, including the spider members, are slid axially through an opening in the front wall of the printer frame. The entire drum assembly is then returned to the manufacturer's facility where the assembly is disassembled and a new drum can be substituted for the worn drum. To install a new drum assembly, the reverse process is carried out, the drum assembly being moved axially inward into the printer frame, until the spiders engage and are seated upon the dowel pins. Thereafter, the work-stations are moved toward the drum surface and their respective operative positions. In a similar manner, each of the individual work-stations may be removed from the printer housing, leaving behind, when the drum assembly has been removed, a frame that is totally void of any major components. Only the registration dowel pins remain in the frame, and the entire printer can be reassembled with great precision based on the location of these pins.

While the above-described apparatus fulfills the work station-registration needs for high quality color printing, it may be viewed as a relatively costly and labor intensive solution. For example, to replace the drum surface, the entire drum assembly, which including the relatively costly drum-support members (spiders) and axles, must be replaced. This requires removal of a relatively heavy subsystem from the printer housing and shipment of such subsystem back to the manufacturing for refurbishing. Since most of the drum assembly components do not require replacement, these components undergo unnecessary shipping and handling during which time they may be damaged or have parts misaligned. This disadvantage is exacerbated by the weight of such components. Ideally, only those components of the drum assemblies that actually need replacement (typically the outermost layer of the drum) should be removed from the printer housing and the remaining components should stay in place for the life of the printer.

In the above-referenced U.S. patent application Ser. No. 09/574,425, there is disclosed a document printer of the above type in which a front drum-support member that normally serves to rotatably support both the image-recording and image-transfer drums is selectively decoupleable from these drums so that the respective outer surfaces of the drums may be serviced and/or replaced while the remaining portions of the drums remain within the printer frame. Such a drum support comprises a pair of double-acting, air cylinder-operated clamps, each being adapted to either grasp or release one of the two opposing axle bearings on each of the drums. When the clamps operate to grasp the axle bearings of the drums, the front drum-support member cooperates with a rear drum-support member to rotatably support the two drums and to properly position the various work-stations of the printer relative to the respective outer surfaces of the drums. When the clamps operate to release the axle bearings, the front drum support can be moved, via an articulated mounting mechanism, between its operative position and a standby position within the machine frame that is sufficiently remote from the drums as not to interfere with drum servicing. In such a system, it may be appreciated that the rear drum-support member must be capable not only of supporting the two drums in a cantilever fashion when the front drum-support member is decoupled and moved away from the drums, but also of supporting at least one of the drums for relative movement towards and away from the other so that the so that drums may be brought into pressure contact during the printing operation, and spaced apart during periods of non-use or servicing.

SUMMARY OF THE INVENTION

In view of the foregoing discussion, an object of this invention is to provide an improved apparatus for supporting a drum in a cantilever fashion while moving it in a direction substantially parallel to its intended axis of rotation.

Another object of this invention is to provide a printing apparatus in which a pair spaced parallel drums of the type described are rotatably supported and movable relative to each other so that the respective outer surfaces of the drums may be spaced apart or moved into pressure contact.

According to one aspect of the invention, a cantilever drum-mounting apparatus comprises a housing having an opening therein; a carriage movably mounted within the opening and adapted to receive, retain and rotatably support an axle of a drum, such axle defining an axis for drum rotation; and a plurality of guide rollers mounted on the carriage and engagable with an outer surface of the housing to limit movement of the carriage to a direction substantially normal to the axis for drum rotation. Preferably, movement of the carriage is controlled by an air cylinder mounted on the housing and having a movable actuator that cooperates with one or more reference surfaces within the housing opening to locate the drum axle at a desired position.

According to another aspect of the invention, the cantilever drum-mounting apparatus of the invention is used in a document printer/copier to rotatably support an image-transfer drum and to control the position of such drum relative to the surface of an image-recording drum. Thus, according to this aspect of the invention, a document printer/copier comprises: (i) a frame; (ii) an image-recording drum having a photo-sensitive outer surface and having an outwardly extending axle disposed on an intended axis of drum rotation, such axle supporting a first bearing by which the image-recording drum is rotatably supportable; (iii) a plurality of work-stations for producing transferable images on the drum's photo-sensitive outer surface; (iv) an image-transfer drum having an adhesive outer surface to which toner images previously formed on the image-recording drum are transferable upon being brought into contact with the photo-sensitive outer surface, such image-transfer drum also having an outwardly extending axle disposed on an intended axis of drum rotation, such axle supporting a second bearing by which the image-transfer drum is rotatably supportable; and (v) a drum-support member mounted on the frame and comprising (1) a housing defining (a) a first opening adapted to receive and retain the first bearing at a predetermined location within the first opening, and (b) a second opening spaced from the first opening; (2) a carriage movably mounted on the housing at a location within the second opening for movement toward and away from the first opening, such carriage being adapted to receive and retain the second bearing; and (c) a selectively energizeable actuator for moving the carriage in the second opening to control the spacing between the two drums.

As indicated above, an advantageous technical effect of the invention is that one of the two drum-supports (i.e., the front drum support) disclosed in the above-referenced U.S. patent application Ser. No. 09/574,425 can be decoupled and displaced from the drum axles without disturbing the positional relationship between the image-recording and image-transfer drums. Both drums are supported in parallel positions at all times. While supported at one end only, the image-transfer drum may be lowered or displaced to a position spaced from the image-transfer drum to enable the front drum support to be de-coupled and removed from the drum axles and, after the front drum support has been returned to its operative position, the image-transfer drum can be returned to its operative position, parallel to and in pressure contact with the image-recording drum.

The invention and its advantages will be better understood from the ensuing detailed description of preferred embodiments, reference being made to the accompanying drawings in which like reference characters denote like parts.

DETAILED DESCRIPTION OF PREFERRED EMBODIMENTS

Figure 1:
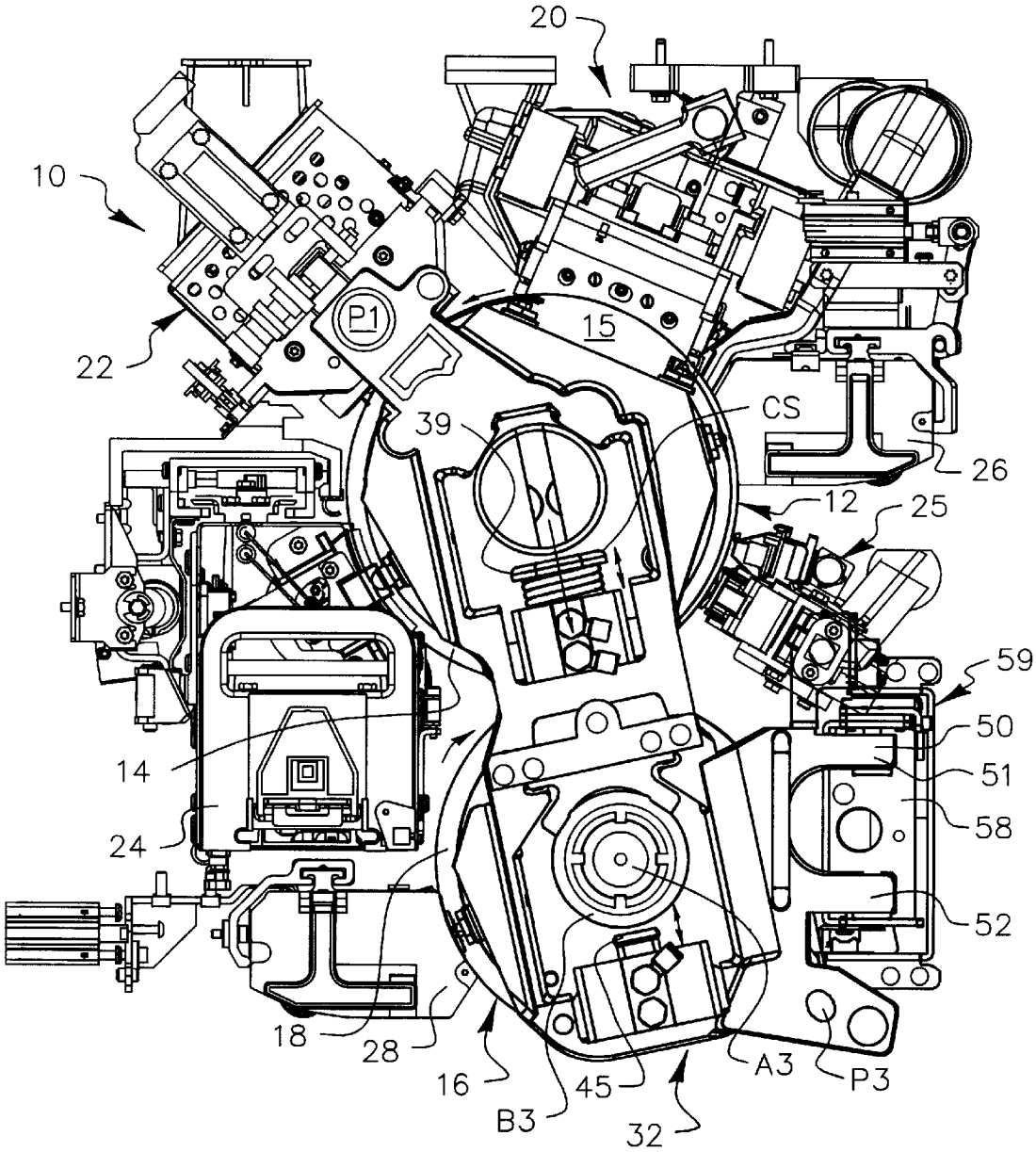
FIG. 1 is a side elevation of a portion of an electrophotographic printer embodying the invention.

Referring now to the drawings, FIG. 1 shows a major portion of an electrophotographic printer 10 embodying the present invention. While the apparatus shown is adapted to produce monochromatic (one color) images, it may be one of several identical printing modules, each being adapted to produce one of the several color-separated images comprising a multicolor print. As shown, printer 10 comprises an image-recording drum 12 having a photoconductive outer surface 14 on which toner images are formed in a conventional manner. As discussed below, surface 14 is part of a replaceable photoconductive tube comprising, for example, an aluminum sleeve, about 8 mm in thickness, having an outer coating of an organic photoconductive material. The photoconductive tube is supported at opposite ends by a pair of circular gudgeons 15,15' which, in turn, are supported by a drum shaft (shown in FIG. 7). The forward gudgeon 15 is releasably attached to the drum shaft so that, when the gudgeon is removed from the drum shaft, the photoconductive tube can be slided axially and thereby be removed from the printer frame and, if necessary, be replaced. The printer also comprises an intermediate image-transfer drum 16 with a compliant adhesive (non-stick) sleeve 18 to which toner images formed on the photoconductive outer surface of image-recording drum 12 are transferred prior to being re-transferred to a receiver sheet (not shown). Like the image-recording drum, the image-transfer drum is structured so that its outer layer can be removed and replaced in the field, i.e., at the customer site. Briefly, the drum 16 comprises a cylindrical mandrel 17 (shown in FIG. 7) which supports a removable adhesive sleeve. Details of the image-transfer drum are disclosed in the above-referenced U.S. patent application Ser. No. 09/574,447.

Briefly, toner images are formed on the photoconductive surface of image-recording drum 12 by rotating the drum in a counter-clockwise direction (as viewed in FIG. 1) past a series of image processing or work-stations that sequentially operate on a desired portion of the drum's photoconductive outer surface to produce a visible toner image. These image processing stations include a corona charging station 20 for uniformly charging the photoconductive surface 14 with electrostatic charges, a solid-state print head or optical writer 22 for imagewise exposing the charged photoconductive surface, line-by-line, to actinic radiation, thereby selectively dissipating the uniform charge and leaving behind a latent electrostatic charge image, and a toning station 24 for developing the charge image with pigmented electroscopic toner particles. The toner image thus formed is then transferred to the outer surface of the image-transfer drum 16, and residual toner on the image-recording drum 12 is removed by a pre-clean corona charger 25 an a cleaning station 26. Upon re-transferring the toner image on the intermediate transfer drum 16 to an image-receiver sheet (not shown), the surface of drum 16 is cleaned by a second cleaning station 28. Preferably, each work station, with the exception of the optical writer is mounted for slight movement (e.g. about 5 to 7 mm.) towards and away from its respective operative position adjacent the drum surface (shown in FIG. 1) to provide adequate clearance for installation and replacement of the processing stations. During such installation, as explained below, these processing stations are moved substantially parallel to drum's respective axis of rotation, through an opening 30 in the front mechanism plate FP of the printer frame F (shown best in FIG. 2).

Figure 2:
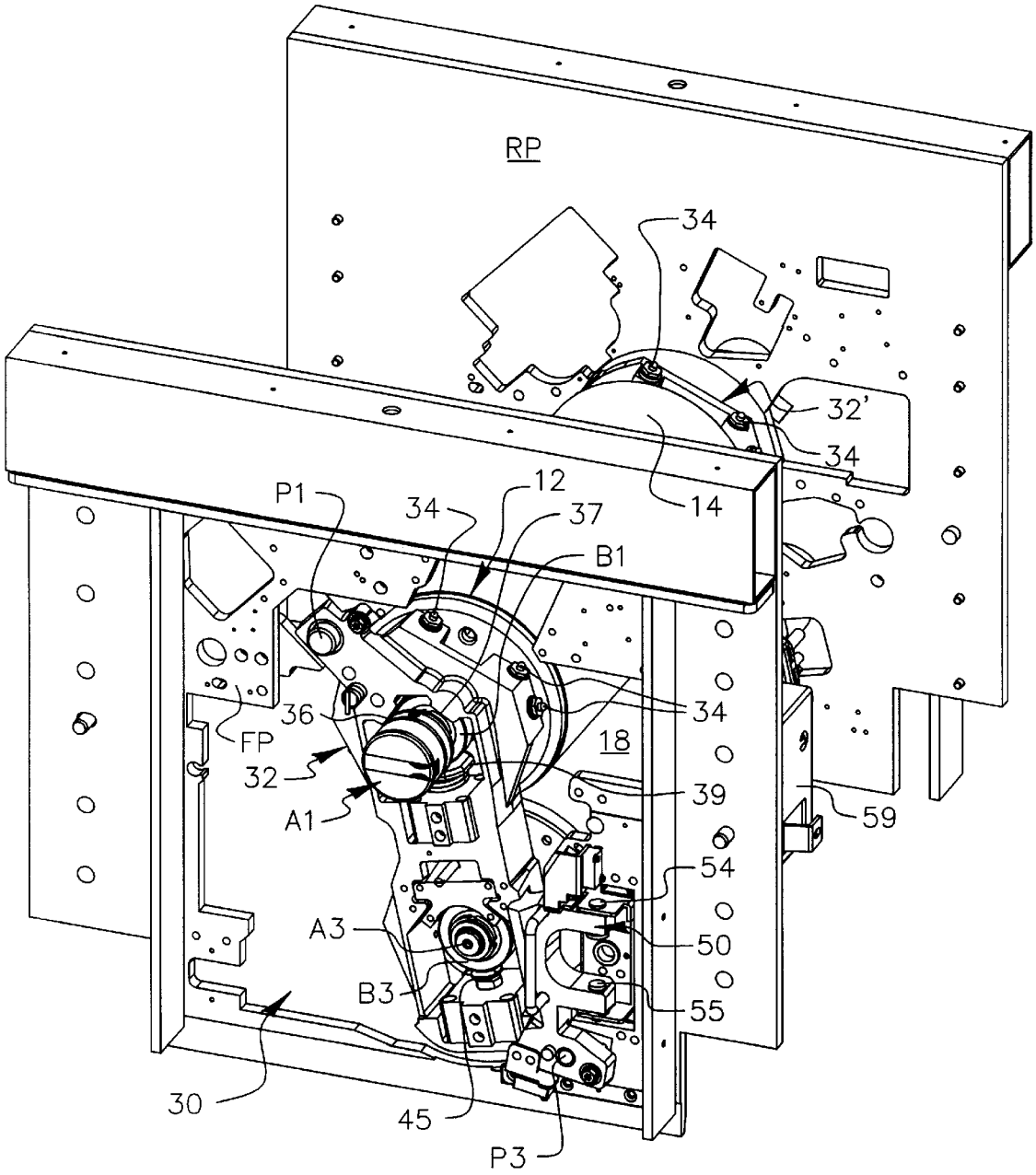
FIG. 2 is a perspective view of a portion of the apparatus shown in FIG. 1.
Figure 5:
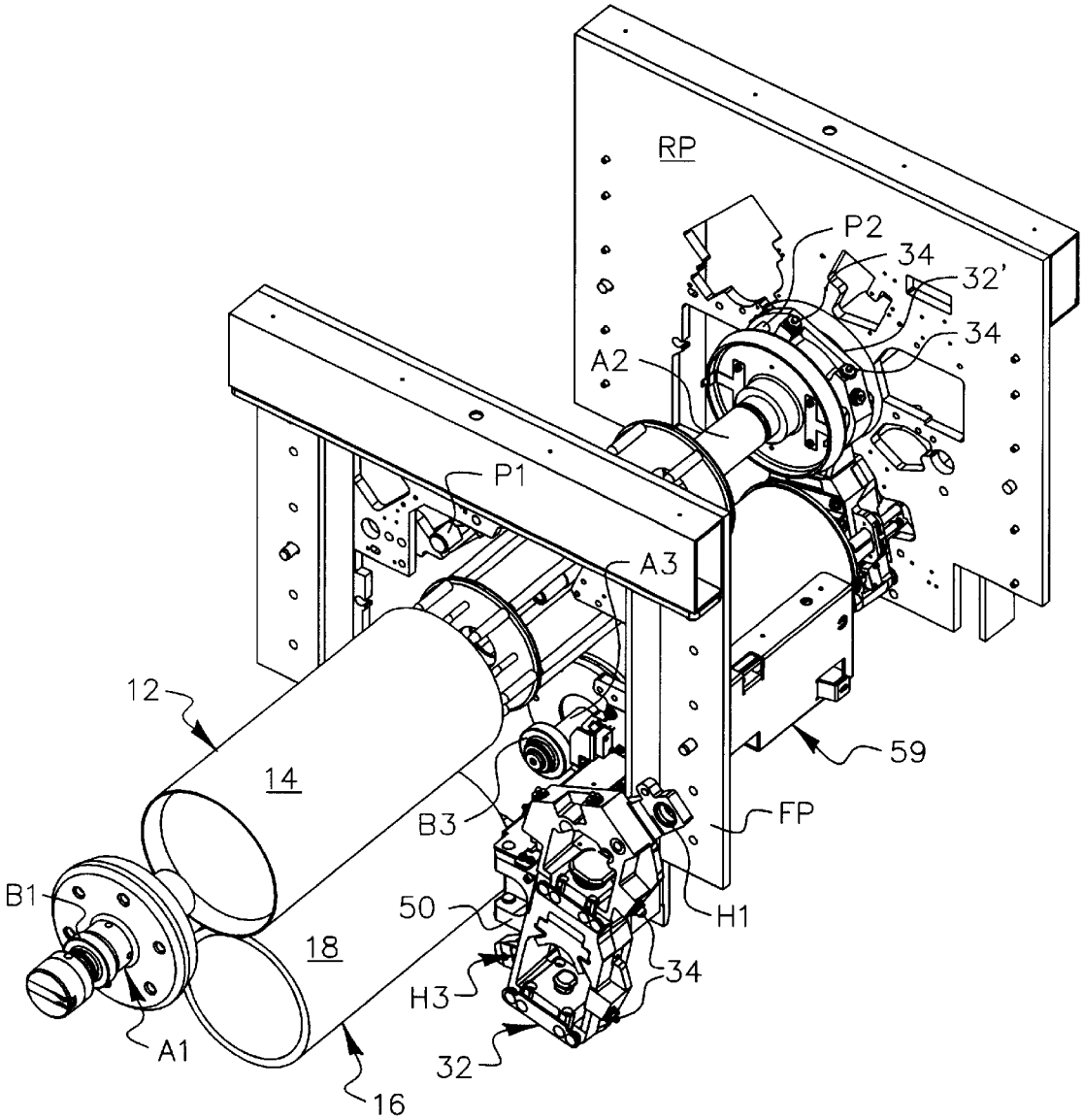
FIG. 5 is a perspective view of a portion of the FIG. 1 apparatus showing the outer layers of the image-recording and image-transfer drums removed.

FIGS. 2 and 5 are a perspective view of the FIG. 1 apparatus with the work-stations 20,22,24,26 and 28 removed. FIG. 5 shows a pair of dowel or "reference" pins P1,P2 mounted on the front and rear plates, FP, RP, respectively of the printer frame. As disclosed in the above-referenced U.S. patent application Ser. No. 09/574,054, these reference pins are engaged by mounting blocks located at opposite ends of the optical writer 22 and thereby serve to control the focus position of the writer relative to the drum's photoconductive surface. As discussed below, pins P1–P4 further serve to precisely locate drums 12 and 16 within the printer frame by precisely positioning a pair of drum-support members used to rotatably support the drums within the printer frame.

Figure 4:
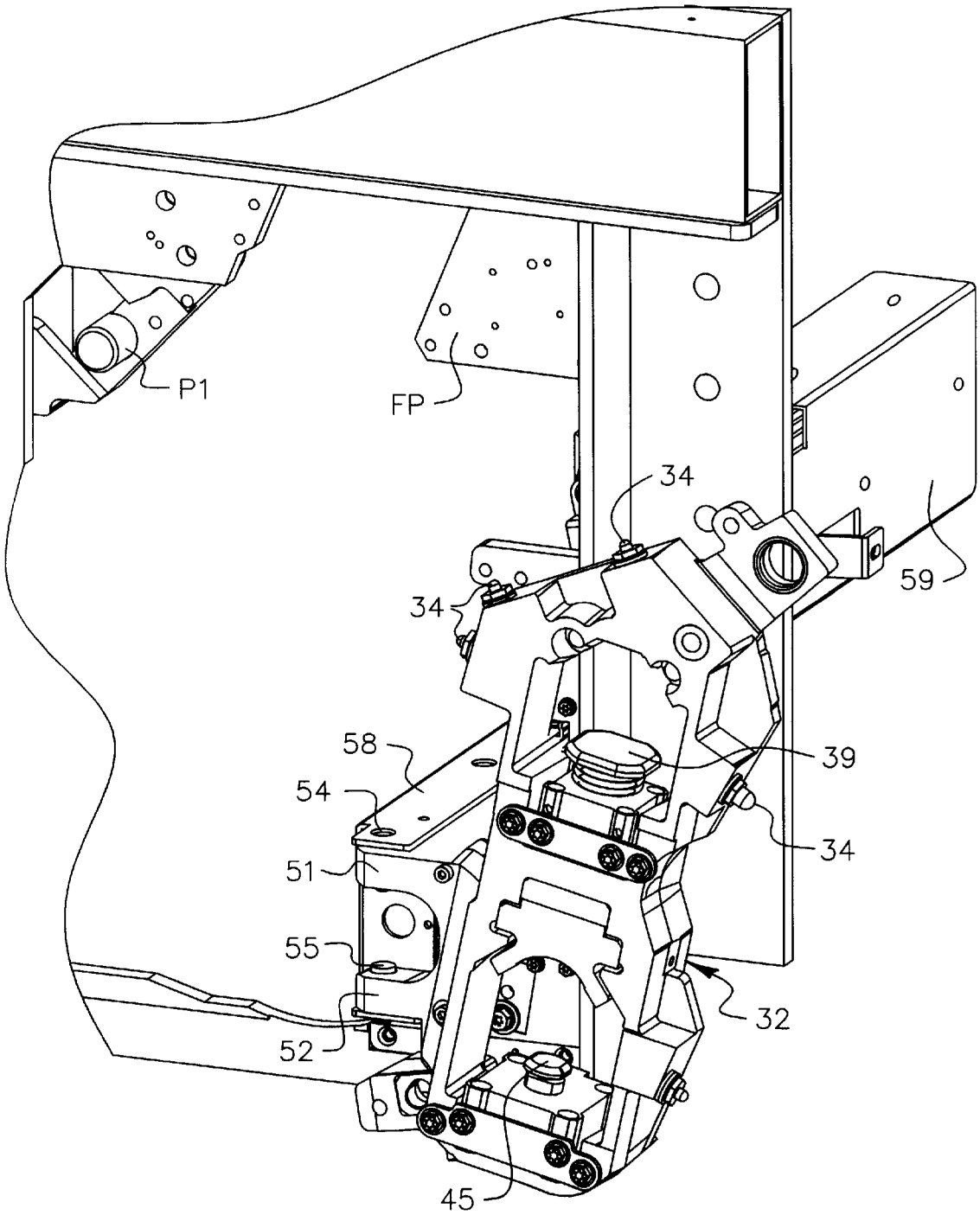
Figure 7:
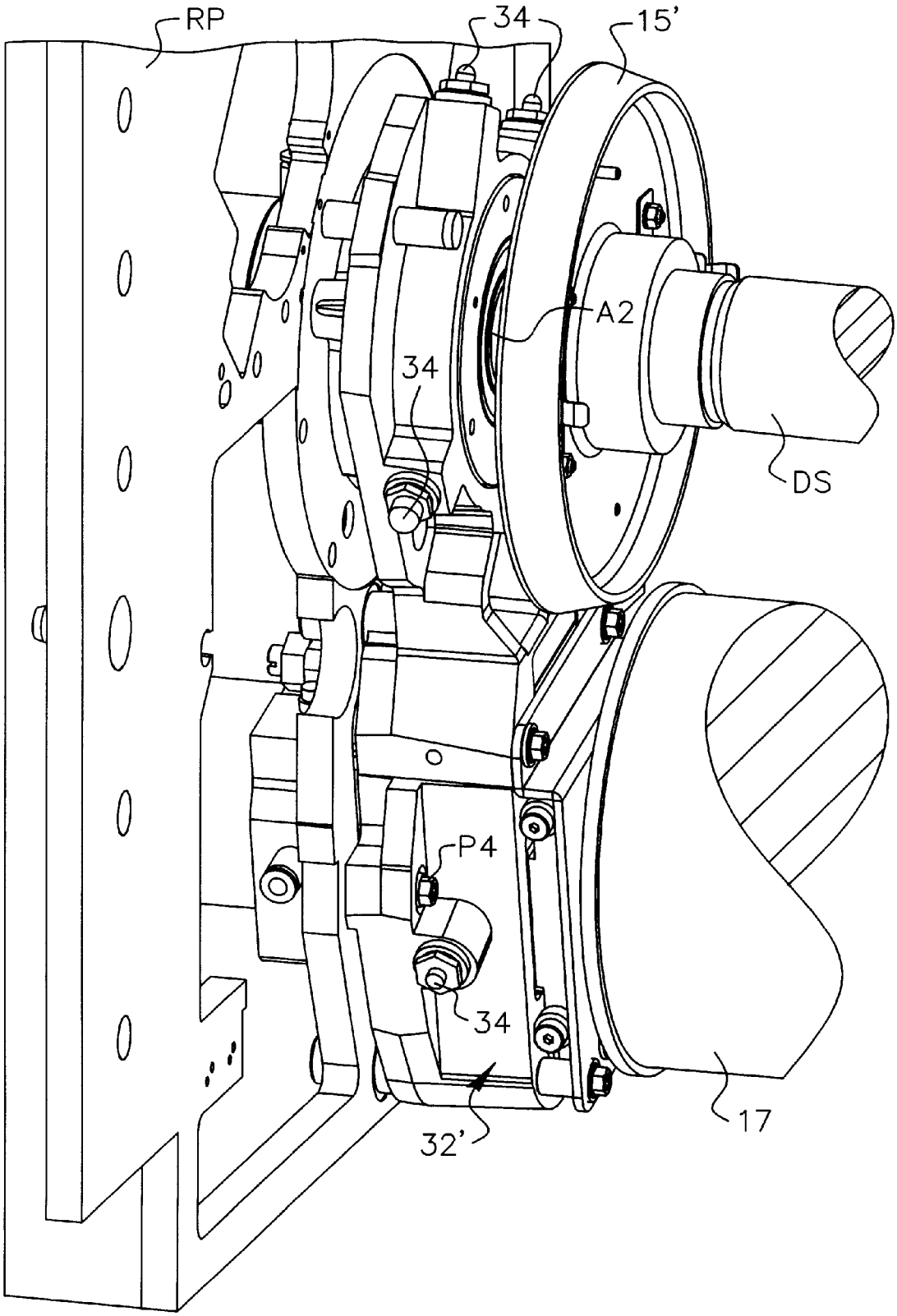
FIGS. 7–10 are front perspective, rear perspective, cross-sectional, and side elevational views, respectively, of portions of the rear drum support shown in FIG. 6B.
Figure 8:
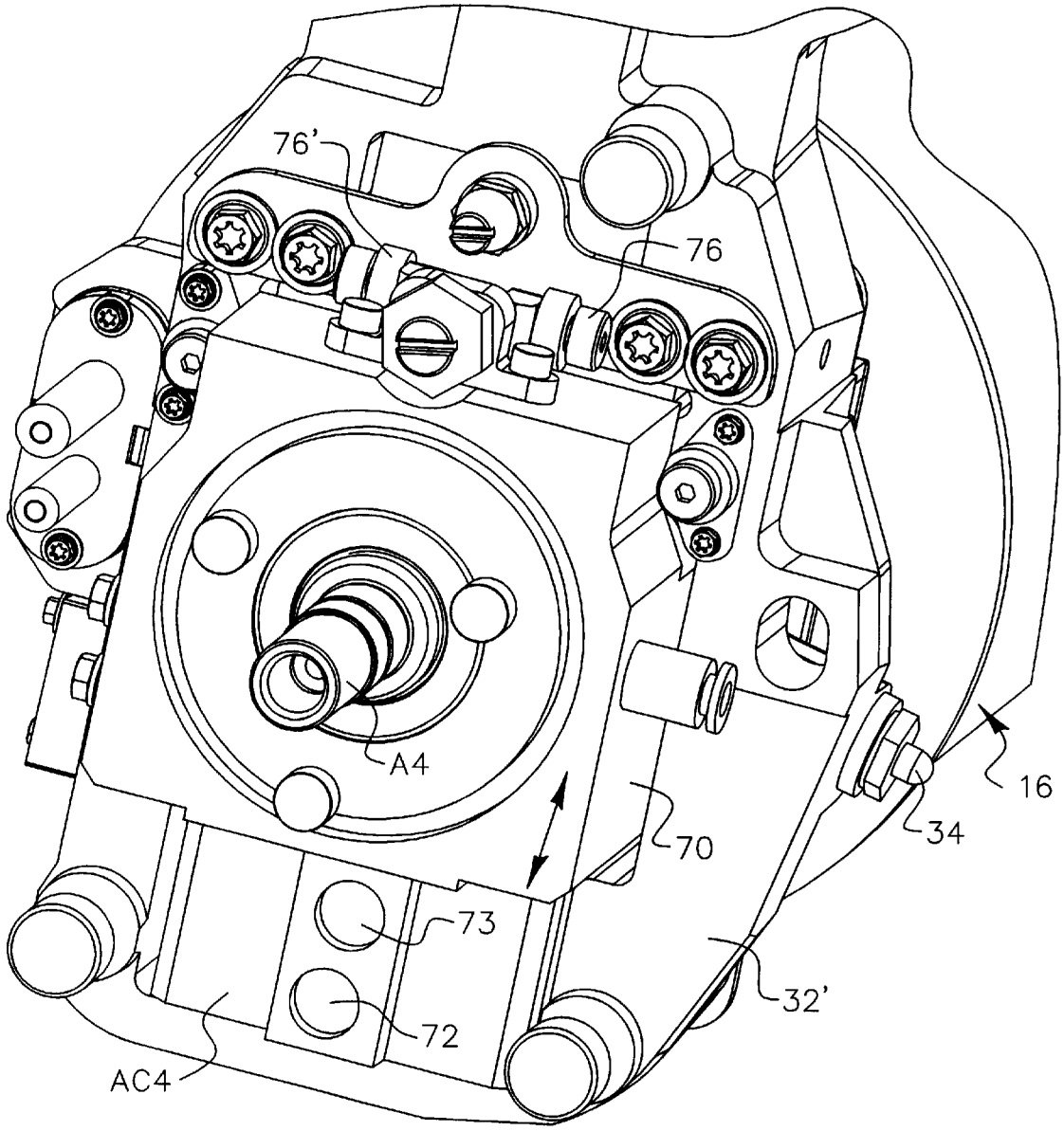

Now in accordance with a preferred embodiment of the invention, drums 12 and 16 are rotatably supported by a front and rear drum-support members 32, 32'. As best shown in FIGS. 5 and 7, the rear drum-support member 32' is rigidly connected to the rear frame plate RP of the printer frame and is precisely located thereon by the reference pins P2 and P4. Rear member 32' serves to rotatably support both drums 12 and 16 by their respective rearwardly-extending axles A2 and A4. Moreover, rear drum-support member supports the image-transfer drum 16 so that it may be moved towards and away from the image-recording drum 12, the rotational axis of which remains stationary. The front drum-support member 32, in contrast with the rigidly mounted rear member, is movably mounted on the front frame plate FP of the printer frame for movement between an operative position (shown in FIG. 2) in which it is capable of rotatably supporting both of the respective forwardly-extending portions of the axles A1 and A3 of drums 12 and 16, and a standby position (shown in FIGS. 4 and 5) in which it is sufficiently spaced from the drum axles to enable, for example, the outer surfaces of the drums to be accessed for service and/or replacement. Each of the drum-support members 32,32' is provided with a plurality of outwardly extending fiducials 34 which, together with similarly located fiducials on the other drum-support member serve to precisely locate the various work-stations of the printer relative to the respective outer surfaces of the drums. This type of work station registration scheme is disclosed in more detail in the above cross-referenced U.S. application Ser. No. 09/474,352.

Figure 6A:
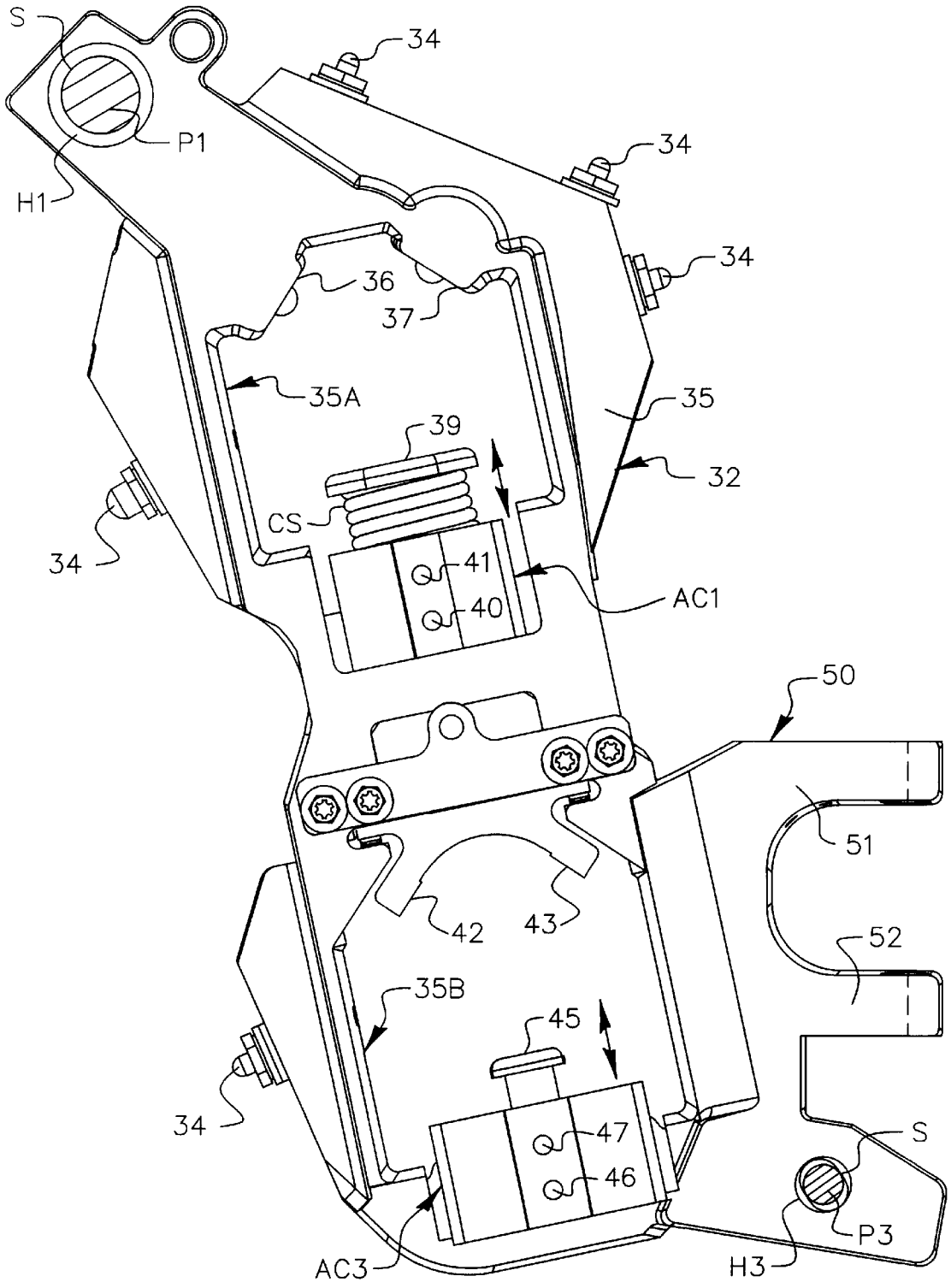
FIGS. 6A and 6B are enlarged side elevations of the front and rear drum supports of the FIG. 1 apparatus.
Figure 6B:
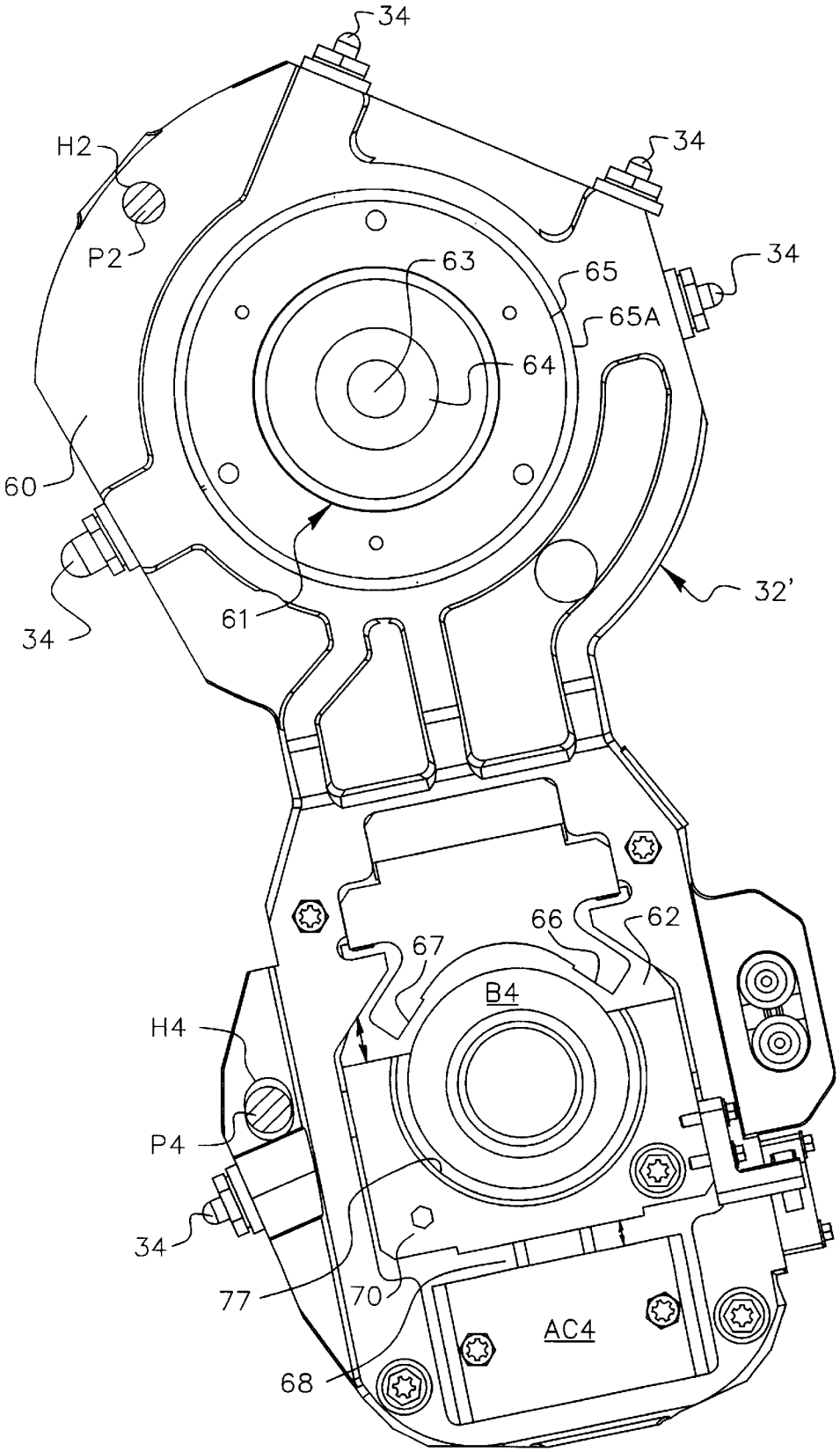

Referring additionally to FIGS. 6A and 6B, the front drum-support member 32 comprises a housing 35 that is preferably made of aluminum and has, generally speaking, a "figure eight" configuration. A circular hole H1 and a slot H3 are provided in housing 35 for receiving pins P1 and P3 carried by the printer's front frame plate FP. Each hole or slot is provided with a sleeve S having a tapered forward edge for facilitating the entry of pins P1 and P3. The upper opening 35A of housing 35 is adapted to receive and rotatably support the front portion of the image-recording drum axle A1, while the lower opening 35B is adapted to receive and rotatably support the front portion of the intermediate transfer drum axle A3. Opening 35A is provided with a pair of reference surfaces 36,37 arranged at 90 degrees with respect to each other, thereby defining a V-notch for receiving the front axle bearing B1 of the image-recording drum 12. Mounted within housing 35 is a selectively energizeable, double-acting air cylinder AC1 having a movable actuator 39 extending into opening 35A. When air is applied through a port 40 of the air cylinder, the actuator moves in a direction towards the apex of reference surfaces 36,37. Thus, when the movably-mounted drum-support member 32 is located in its operative position as shown in FIG. 2, the top (free end) of actuator 39 will engage the bottom portion of the outer race of drum bearing B1 as the actuator moves into opening 35A. As actuator 39 continues to move towards reference surfaces 36,37, it operates to lift the drum axle A1 until the axle bearing B1 contacts the reference surfaces 36,37. At this time, the air cylinder actuator operates collectively with reference surfaces to position the drum axle at a nominal position, that being one that is precisely located with respect to the work station-locating fiducials 34. A compression spring CS assists in maintaining an upward force on the drum axle. When air is applied to port 41, actuator 39 begins to lower (i.e., withdraw into housing 35) and thereby move away from reference surfaces 36,37. As actuator 39 continues to withdraw into housing 35 (e.g., a distance of about 3 or 4 mm.), it eventually looses contact with bearing B1 and, at this time, the image-recording drum 12 is totally supported, in a cantilever fashion, by the rear drum-support member 32'. Owing to a slight play in a rear axle bearing B2 carried on the rear axle A2 of drum 12, the forward, unsupported end of drum 12 sags about 1 mm., causing the upper portion of bearing B1 to lose contact with reference surfaces 36,37. Owing to this sagging of the forward end the image-recording drum and the resulting lose of contact between the forward bearing B3 and the V-notch defined by the reference surfaces, drum support 32 is allowed to move axially, as discussed below, unimpeded by any frictional forces between the surfaces that normally support the drum axle for rotation.

Like opening 35A of housing 35, opening 35B is also provided with a pair of reference surfaces 42,43 for locating the front axle A3 of the intermediate image-transfer drum 16. A second air cylinder AC3 contained in housing 35 has a selectively movable actuator 45 that is positioned to engage bearing B3 (best shown in FIG. 5) on the forward end of drum axle A3 when drum-support member is in its operative position. Thus, when actuated by applying air through port 46, air cylinder AC3 operates to advance actuator 45 towards the apex of reference surfaces 42,43; in doing so, the actuator engages the lower peripheral portion of the outer race of bearing B3 and raises the top part of the bearing into engagement with the V-notch defined by reference surfaces 42 and 43. When so positioned, and when the transfer drum has been raised by the rear drum-support member 32' to its operative position (as explained below), the outer surface of the transfer drum engages the photoconductive surface and applies sufficient pressure to establish a desired transfer nip of predetermined width (e.g., 5 mm). When air is applied to the lower port 47 of air cylinder AC3, actuator 45 lowers (i.e., withdraws into housing 35). As actuator 45 lowers, the drum axle it supports moves with it, thereby causing the outer surface of the image-transfer drum to lose contact with the image-transfer drum. Note, at the same time the front end of the image-transfer drum is lowered (or raised) the rear end of the drum is moved a corresponding difference via the rear drum-support member 32', as explained below. When actuator 45 has been lowered by a distance of about 5 mm., it loses contact with drum bearing B3. At this point, the image-transfer drum 16 is totally supported, in a cantilever fashion, by drum-support member 32'.

Figure 3:
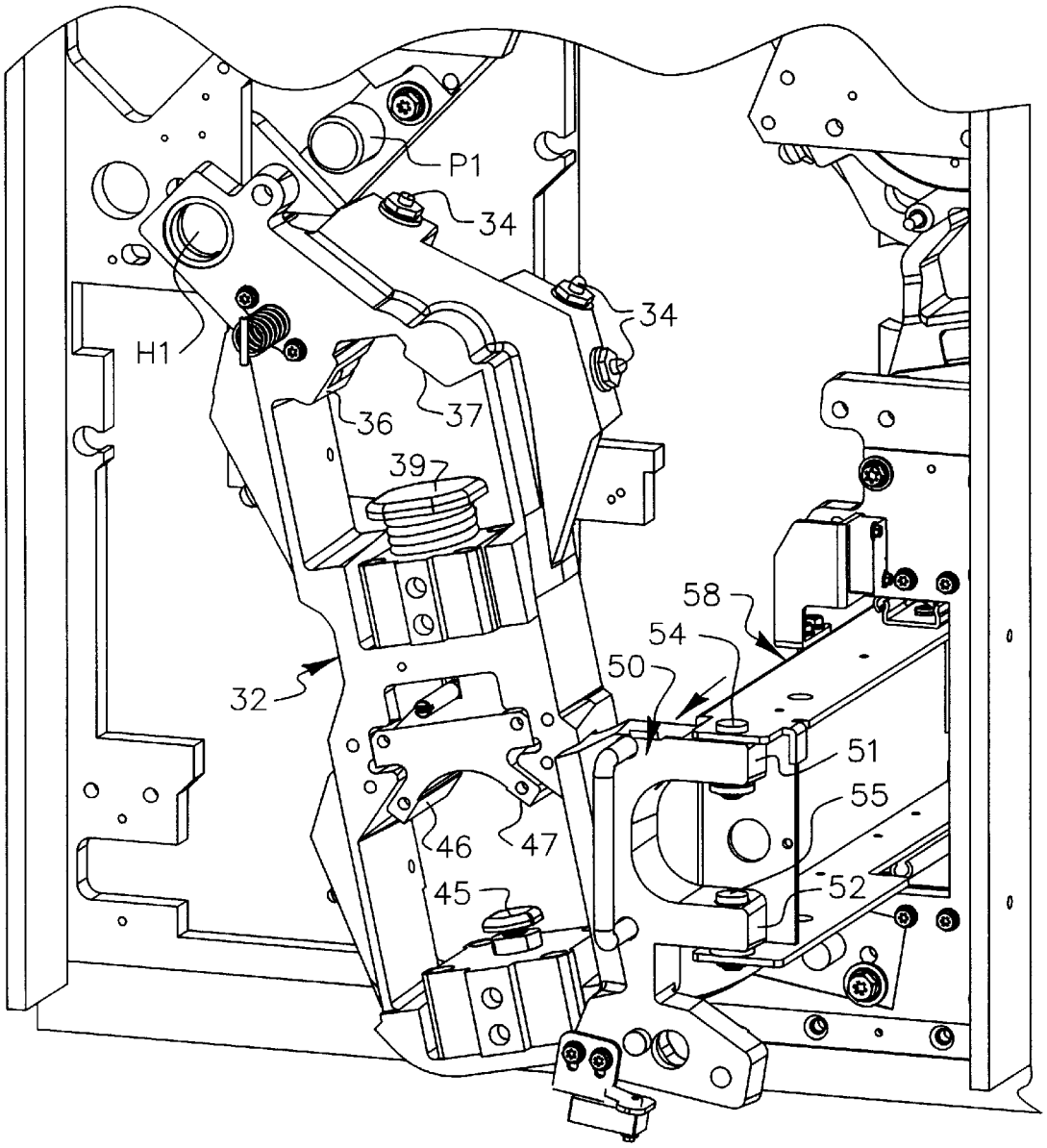
FIGS. 3 and 4 are enlarged perspective views of a movably mounted drum support member in two different positions.

Thus, as explained above, the front drum-support member 32, by virtue of its selectively energizeable clamps, is adapted to either (i) be an integral part of the drum assemblies and function to rotatably support the respect drum axles of drums 12 and 16, as occurs when the actuators 39 and 45 are in their respective UP positions, or (b) be de-coupled from the drum assemblies, as occurs when the actuators are in their respective DOWN positions. As noted earlier, it is important to the invention that drum-support member 32 not only be able to be decoupled from the drum assemblies, but also be movable to a position within the printer frame where it does not interfere with the servicing of the respective drum surfaces. Thus, in addition to carrying structure for precisely positioning and rotatably supporting the axles of drums 12 and 16, the front drum support member 32 is provided with structure by which it can be slid in a direction parallel to the respective axes of rotation of the drums, whereby it may be moved forwardly of the respective drum axles A1 and A3, as well as be pivoted about an axis normal to the drum axes, whereby member 32 can be substantially displaced from the drums. As shown in FIGS. 1–4 and 6A, housing 35 has an integral yoke portion 50 comprising a pair of spaced arm members 51,52. The arm members of yoke 50 are pivotally mounted on a pair of pivot pins 54,55 carried by an end of a movable carriage 58 that is slidably mounted in a track 59 extending between the printer frame plates FP and RP. Pivot pins 54,55 share a common axis that is perpendicular to the axes of the drums. Track 59, on the other hand, extends in a direction parallel to the drum axes. Thus, when the respective air cylinders of drum-support member 32 are de-actuated, in which case the respective actuators 39 and 45 and reference surfaces 36,37 and 42,43 are spaced from the front axle bearings B1 and B3 of the two drums, the drum-support member 32 can be slid forward, off of pins P1 and P3 and along track 59, from its operative position (in which openings 35A and 35B surround bearings B1 and B3), to an intermediate standby position in which member 32 is located substantially forward of the plane of front frame plate FP (as shown in FIG. 3), and substantially spaced from the forward ends of the drums. Thereafter, member 32 can be pivoted 180 degrees about pivot pins 54,55 to a final standby position, shown in FIG. 5. In this position, both drums can be accessed for removal of their respective outer layers. Printing apparatus in which the outer sleeve or tube of a print drum is readily replaceable while the drum shaft is still physically attached to the printer frame is disclosed, for example, in U.S. Pat. No. 4,119,032. An image-transfer drum of the type in which the outer adhesive layer is easily replaceable while the drum mandrel is still physically attached to the printer frame is disclosed in the above-referenced U.S. application Ser. No. 09/574,447.

Referring to FIG. 6B, rear drum support member 32,' like member 32, also comprises a "figure eight"—shaped housing 60. Housing 60 is provided with a pair of holes H2 and H4 for receiving the reference pins P2 and P4 extending inwardly from the front side of the rear frame plate RP. Hole H2 is circular and only slightly larger in diameter than pin P2, whereas hole H4 is slightly elongated to facilitate mounting on pin P4 once pin P2 has engaged hole H2. As noted above, the rear drum-support is rigidly connected to the rear frame plate by bolts or the like. Once in place, the rear drum-support member 32' remains stationary. The upper opening 61 of the figure-eight housing 60 serves to rotatably support the rear axle A2 of the image-recording drum, whereas the lower opening 62 serves to rotatably and releasably support the rear axle A4 of the image-transfer drum. Upper opening 61 has a small circular through aperture 63 through which the free end of rear axle A2 projects. Surrounding aperture 63 is a circular recess 64 adapted to receive an inner portion of axle A2 of somewhat larger diameter than that projecting through aperture 63. A circular recess 65 with a chamfered edge 65A surrounds recess 64 and is adapted to receive, via a press fit, a ball bearing B2 mounted on rear axle A2. It will be noted that bearing B2 is the only one of any of the four drum bearings B1–B4 to remain fixed in space (i.e., stationary) within either drum support.

Figure 9:
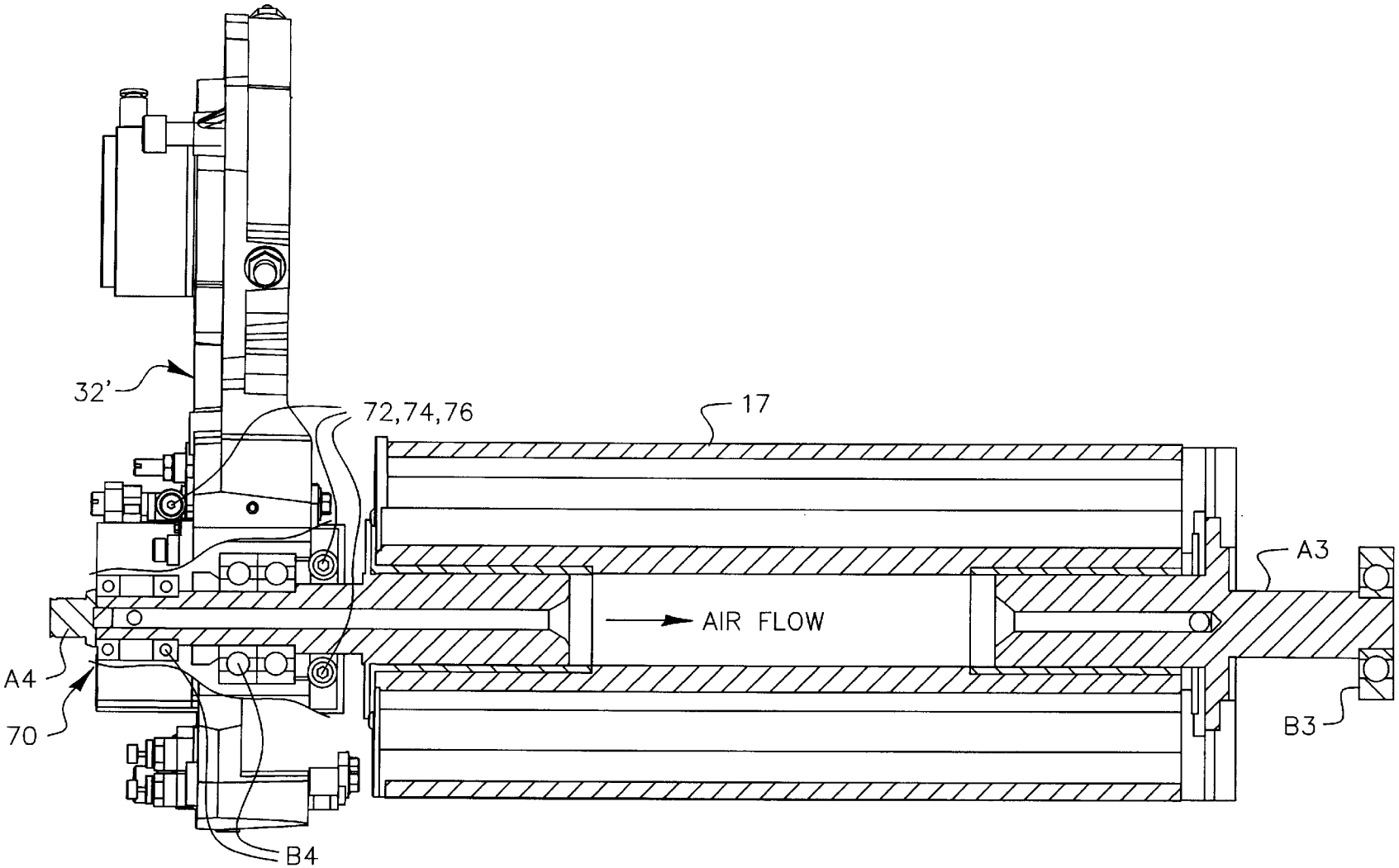

Positioned in the lower opening 62 of housing 60 is a pair of reference surfaces 66,67 for precisely locating the rear axle bearing B4 carried by the rear axle A4 of the image-transfer drum 16 so that a desired image-transfer nip can be attained between the respective outer surfaces of drums 12 and 16. Surfaces 66,67 cooperate with the movable actuator 68 of a selectively energizeable air cylinder AC4 to position the rear axle bearing of the transfer drum in the V-notch defined by surfaces 66,67. Bearing B4, which, as shown in FIG.9, is actually a precision double ring bearing, is press fit in a pocket 69 contained in a carriage 70 that is movably mounted within the lower opening 62 of the rear drum-support member 32'. As shown, pocket 69 surrounds only about 220 degrees of the circular bearing B4 to allow clearance for the carriage to move upwardly, in the directions of the arrows, by about 5 mm. Such movement is sufficient to bring the upper portion of the bearing into a seating contact with surfaces 66, 67, and to sufficiently space the drum surfaces apart to prevent either drum surface from being deformed or taking a set by prolonged contact with the other drum surface. Such spacing also enable the front drum support 32 to move unimpeded to its standby position (shown in FIG. 4).

Figure 10:
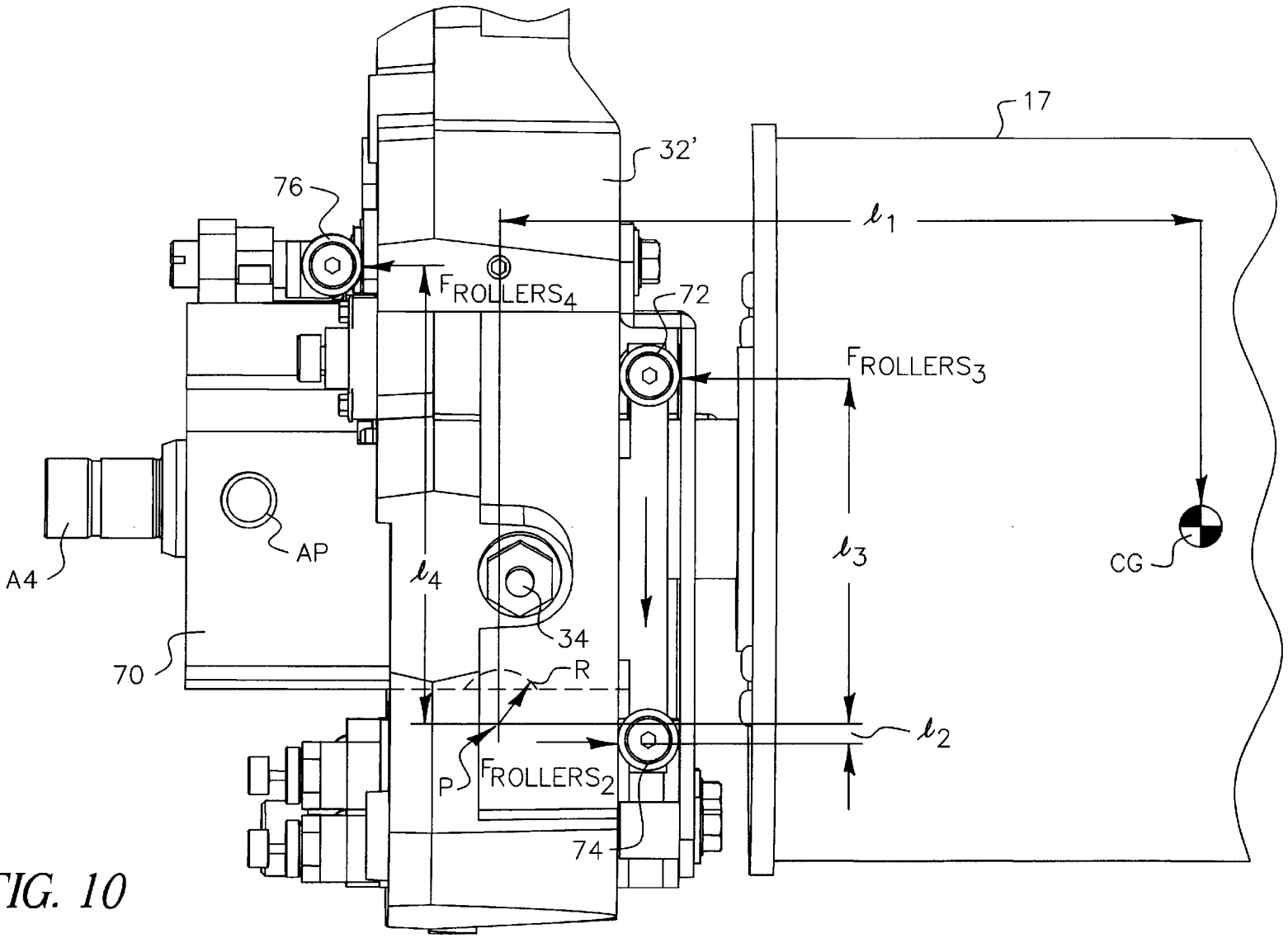

Referring to FIGS. 7–10, the direction of movement of carriage 70 substantially perpendicular to the drum axis of rotation is controlled by a three pairs of guide rollers 72, 72',74,74' and 76,76' that are rotatably mounted on the carriage. Note, rollers 72' and 74' are not shown in the drawings, but are located in positions corresponding to rollers 72 and 74, on the opposite side of the drum axle A4. These guide rollers ride atop the front and rear parallel surfaces of member 32' and limit movement of drum 16 so as to maintain a parallel relationship between the respective axes of rotation of drums 12 and 16. An L-shaped bracket 78 mounted on the front side of the drum-support member 32' assures that roller pairs 72, 72' and 74,74' maintain contact with the front surface of member 32 and thereby prevent drum 16 front tipping clockwise, as viewed in the drawings. An additional pair of guide roller 78,78' serves to direct the movement of carriage 70 at a desired line of contact on the surface of the image-recording drum. Note, due to the printer geometry, this line of contact is offset by about 12 degrees from the shortest line connecting the drum axes. Such geometry requires that the top surface of actuator 68 is spherically-shaped and that it be received in a correspondingly shaped recess formed in the base of carriage 70. Referring to FIG. 10, the torque resulting from the weight of the transfer drum acting through the moment arm measured from the drum's center of gravity CG and the point P where the actuator 68 supports the carriage 70 ($W_{drum} \times L_1$) is offset by the counter-torque exerted by the guide rollers ($F_{74} \times L_2 + F_{72} \times L_3 + F_{76} \times L_4$). In such case, the drum axis will remain horizontal even when the front drum support 32 is de-coupled and removed.

The invention has been described with reference to a particularly preferred embodiment. It will be apparent, however, that certain modifications can be made without departing from the spirit of the invention, and such modifications are intended to be protected by the following claims.

Parts List

10—printer
12—image-recording drum
14—photoconductive surface
15,15'—gudgeons
DS—drum shaft
16—image-transfer drum
17—mandrel
18—non-stick sleeve
20—corona charging station
22—optical writer
24—development station
25—pre-clean charger
26—cleaning brush
28—image-transfer drum cleaner
P1–P4—reference pins
H1–H4—mounting holes
FP—front frame plate
RP—rear frame plate
32,32'—front and rear drum-support members, respectively.
34—reference fiducials
35—front drum-support housing
35A,35B—openings in housing 35
A1–A4 drum axles
B1–B4 axle bearings
36,37—reference surfaces
AC1, AC3, AC4—air cylinders
39—actuator
CS—spring
42,43—reference surfaces
45—actuator
46,47—air ports
50—yoke portion
51,52—arms
54,55—pivot pins
58—carriage
59—track
60—housing of rear drum support 32'
61,62—openings in housing 60
63—aperture
64—recess
65—recess
65A—chamfered edge
66,67—reference surfaces
68—actuator
69—bearing pocket
70—carriage
72,72',74,74',76,76',78,78'—guide rollers
80—bracket

What is claimed is:

1. A cantilever drum-mounting apparatus comprising: (i) a housing having an opening therein; (ii) a carriage movably mounted within the opening and adapted to receive, retain and rotatably support an axle of a drum, such axle defining an axis for drum rotation; and (iii) a plurality of guide rollers mounted on the carriage and engageable with an outer surface of the housing to limit movement of the carriage to a direction substantially normal to the axis for drum rotation.

2. The apparatus as defined by claim 1 wherein movement of said carriage is controlled by an air cylinder mounted on the housing and having a movable actuator that cooperates with one or more reference surfaces within the housing opening to locate the drum axle at a desired position.

3. The apparatus as defined by claim 1 wherein said plurality of guide rollers engage opposite sides of said housing.

4. A document printer/copier comprising:

(i) a frame;

(ii) an image-recording drum having a photo-sensitive outer surface and having an outwardly extending axle disposed on an intended axis of drum rotation, said axle supporting a first axle bearing by which said image-recording drum is rotatably supportable;

(iii) a plurality of work-stations for producing transferable images on the drum's photo-sensitive outer surface;

(iv) an image-transfer drum having an outer surface to which toner images formed on said image-recording drum are transferable upon being brought into contact with said photo-sensitive outer surface, said image-transfer drum having an outwardly extending axle disposed on an intended axis of drum rotation, said axle supporting a second axle bearing by which said image-transfer drum is rotatably supportable; and (v) a stationary drum-support member mounted on said frame at a predetermined location and comprising: (a) a housing defining a first opening adapted to receive and retain said first bearing at a predetermined location within said first opening, and a second opening spaced from said first opening; (b) a carriage movably mounted on said housing within said second opening for movement toward and away from said first opening, said carriage being adapted to receive and retain said second bearing; and (c) a selectively energizeable actuator for moving said carriage in said second opening.

5. The apparatus as defined by claim 4 wherein said housing defines a pair of reference surfaces arranged in said second opening and adapted to be contacted by a portion of said second axle bearing as said carriage moves toward said first opening by said actuator, whereby the pressure between the outer surfaces of said drums is controllable.

6. The apparatus as defined by claim 4 wherein actuator is part of a double-acting air cylinder.

7. The apparatus as defined by claim 4 wherein said carriage has a plurality of guide rollers mounted thereon for controlling the movement of said carriage within said second opening.

8. The apparatus as defined by claim 4 wherein said housing defines a set of mechanical fiducials for locating at least one of said work-stations relative to said photo-sensitive surface.

9. The apparatus as defined by claim 8 further comprising a movable drum-support member mounted on said frame for movement between an operative position in which it cooperates with said stationary drum-support member to rotatably support said drums, and a standby position in which it is spaced from said drums, said movable drum-support member comprising: (a) a pair of selectively energizable clamps, each being adapted to selectively engage the second axle bearing on each of said image-recording and image-transfer drums, and (b) a second set of mechanical fiducials that cooperate with said first set of mechanical fiducials for locating said at least one of said work-stations relative to the respective drum surfaces.

* * * * *